US012134841B1

(12) United States Patent
Owens, Jr. et al.

(10) Patent No.: US 12,134,841 B1
(45) Date of Patent: Nov. 5, 2024

(54) COMPOSITE-INTEGRATED ELECTRICAL NETWORKS

(71) Applicant: Nautilus Defense LLC, Pawtucket, RI (US)

(72) Inventors: James B. Owens, Jr., Lincoln, RI (US); Zane A. Lewis, Foster, RI (US)

(73) Assignee: NAUTILUS DEFENSE LLC, Pawtucket, RI (US)

( * ) Notice: Subject to any disclaimer, the term of this patent is extended or adjusted under 35 U.S.C. 154(b) by 0 days.

(21) Appl. No.: 17/701,360

(22) Filed: Mar. 22, 2022

Related U.S. Application Data

(60) Provisional application No. 63/165,497, filed on Mar. 24, 2021.

(51) Int. Cl.
*D02G 3/44* (2006.01)
*D02G 3/12* (2006.01)
*D04C 1/12* (2006.01)

(52) U.S. Cl.
CPC ..... *D02G 3/441* (2013.01); *D02G 3/12* (2013.01); *D04C 1/12* (2013.01); *D10B 2101/12* (2013.01)

(58) Field of Classification Search
CPC ..... D02G 3/12; D02G 3/441; D04C 1/12
USPC ..... 428/297.4
See application file for complete search history.

(56) References Cited

U.S. PATENT DOCUMENTS

| | | | |
|---|---|---|---|
| 2,114,496 | A | 4/1938 | Keating |
| 3,014,087 | A | 12/1961 | Kaplan et al. |
| 4,819,914 | A | 4/1989 | Moore |
| 4,973,029 | A | 11/1990 | Robbins |

(Continued)

FOREIGN PATENT DOCUMENTS

| | | | |
|---|---|---|---|
| DE | 69732664 | T2 | 4/2005 |
| DE | 102006051001 | A1 | 4/2008 |

(Continued)

OTHER PUBLICATIONS

"DuPont(TM) Kevlar(R) 49 Aramid Fiber", http://www.matweb.com/search/datasheet.aspx?MatGUID=77b5205f0dcc43bb8cbe6fee7d36cbb5&ckck=1, Downloaded Dec. 8, 2021.

(Continued)

*Primary Examiner* — Shaun R Hurley

(74) *Attorney, Agent, or Firm* — Philip D. Askenazy; Peacock Law P.C.

(57) ABSTRACT

A composite material comprising braided composite yarns that can be embedded within or at the surface of the material. The braided composite yarns can incorporate one or more multicomponent fiber bundles. The braided composite yarns can be the axial yarns in a triaxial braided fabric that has structural yarns as the bias yarns. The composite material can comprise a carbon fiber prepreg. The thickness of each braided composite yarn can be approximately the thickness of a single composite ply. At least one conductive wire can be wrapped around an axial yarn of the braided composite yarn at a location desirable for electrical contact to be made to at least one conductor in the axial yarn. At least some of the conductive wire is preferably soldered to at least one of the conductors. The conductive wire can be twisted with a structural yarn and is stitched across the braided composite yarn. A conductive pad can be soldered to the one conductive wire.

14 Claims, 8 Drawing Sheets
(8 of 8 Drawing Sheet(s) Filed in Color)

(56) References Cited

U.S. PATENT DOCUMENTS

| | | | | |
|---|---|---|---|---|
| 5,036,166 | A | 7/1991 | Monopoli | |
| 5,058,818 | A | 10/1991 | Haehnel et al. | |
| 5,392,683 | A | 2/1995 | Farley | |
| 5,741,332 | A | 4/1998 | Schmitt | |
| 5,809,861 | A * | 9/1998 | Hummel | D04C 1/12 87/8 |
| 5,901,632 | A * | 5/1999 | Ryan | D07B 5/12 57/22 |
| 5,906,004 | A * | 5/1999 | Lebby | D03D 15/242 2/905 |
| 5,931,076 | A * | 8/1999 | Ryan | D07B 7/169 87/8 |
| 6,210,771 | B1 * | 4/2001 | Post | H05K 1/038 361/212 |
| 6,341,550 | B1 * | 1/2002 | White | A01K 3/005 87/8 |
| 7,240,599 | B2 | 7/2007 | Nolan | |
| 7,516,605 | B2 | 4/2009 | Goldwater et al. | |
| 7,770,837 | B1 | 8/2010 | Head et al. | |
| 7,954,746 | B1 | 6/2011 | Head et al. | |
| 8,555,472 | B2 | 10/2013 | Cavallaro | |
| 8,859,088 | B2 | 10/2014 | Broughton et al. | |
| 8,918,970 | B2 | 12/2014 | Hayse | |
| 9,181,642 | B2 | 11/2015 | Cahuzac | |
| 9,433,489 | B2 * | 9/2016 | Reilly | A61F 2/0063 |
| 9,481,948 | B2 | 11/2016 | Branscomb et al. | |
| 9,745,679 | B2 | 8/2017 | Zhang et al. | |
| 10,182,760 | B2 | 1/2019 | Nicoletti et al. | |
| 10,487,423 | B2 | 11/2019 | Riethmüller et al. | |
| 10,555,581 | B2 * | 2/2020 | Bruce | D04C 3/48 |
| 10,557,220 | B2 * | 2/2020 | Fu | A61B 5/01 |
| 11,873,590 | B1 | 1/2024 | Williams | |
| 2003/0056599 | A1 | 3/2003 | Van et al. | |
| 2003/0205041 | A1 | 11/2003 | Baker | |
| 2005/0082083 | A1 | 4/2005 | Nolan | |
| 2005/0229770 | A1 * | 10/2005 | Smeets | D04C 1/12 87/8 |
| 2006/0148355 | A1 | 7/2006 | Davis et al. | |
| 2006/0211934 | A1 | 9/2006 | Hassonjee et al. | |
| 2008/0091097 | A1 * | 4/2008 | Linti | A61B 5/282 600/389 |
| 2009/0176427 | A1 | 7/2009 | Hansen et al. | |
| 2010/0077528 | A1 | 4/2010 | Lind et al. | |
| 2010/0229456 | A1 * | 9/2010 | Nakanishi | D04C 1/12 428/377 |
| 2012/0108699 | A1 | 5/2012 | Fang et al. | |
| 2014/0157974 | A1 | 6/2014 | Cahuzac | |
| 2014/0172096 | A1 * | 6/2014 | Koob | D03D 15/233 139/35 |
| 2014/0377488 | A1 | 12/2014 | Jamison | |
| 2016/0284436 | A1 | 9/2016 | Fukuhara et al. | |
| 2016/0326675 | A1 | 11/2016 | Kinugasa | |
| 2017/0035149 | A1 | 2/2017 | Bruce et al. | |
| 2017/0107647 | A1 * | 4/2017 | Riethmüller | D02G 3/12 |
| 2017/0232538 | A1 | 8/2017 | Robinson et al. | |
| 2017/0233903 | A1 | 8/2017 | Jeon | |
| 2018/0087191 | A1 | 3/2018 | Threlkeld | |
| 2018/0087193 | A1 | 3/2018 | Fu et al. | |
| 2018/0255639 | A1 * | 9/2018 | Bergman | H05K 1/189 |
| 2018/0363175 | A1 * | 12/2018 | Bayraktar | B29C 70/24 |
| 2019/0021407 | A1 * | 1/2019 | Howland | A41D 1/005 |
| 2019/0062951 | A1 | 2/2019 | Rizk et al. | |
| 2019/0079582 | A1 | 3/2019 | Lyons et al. | |
| 2019/0327832 | A1 | 10/2019 | Holbery et al. | |
| 2020/0125195 | A1 * | 4/2020 | Tremmel | D03D 1/0088 |
| 2020/0270775 | A1 * | 8/2020 | Oppenheim | D02G 3/12 |
| 2020/0325603 | A1 | 10/2020 | King et al. | |
| 2021/0008815 | A1 | 1/2021 | Huoponen et al. | |
| 2021/0206481 | A1 * | 7/2021 | Brion | B64C 27/473 |
| 2021/0277544 | A1 | 9/2021 | King et al. | |
| 2022/0056619 | A1 * | 2/2022 | Owens, Jr. | D02G 3/36 |

FOREIGN PATENT DOCUMENTS

| | | | | |
|---|---|---|---|---|
| DE | 102017123922 | A1 | 4/2019 | |
| EP | 0290977 | A1 | 11/1988 | |
| EP | 0482489 | A1 | 4/1992 | |
| EP | 1537264 | B1 | 5/2006 | |
| FR | 2625599 | A1 * | 7/1989 | |
| FR | 2755577 | A1 | 5/1998 | |
| JP | 4174 | | 3/1939 | |
| JP | H01300834 | A | 12/1989 | |
| JP | H0623558 | U | 3/1994 | |
| JP | 10168699 | A * | 6/1998 | |
| JP | 2001073241 | A * | 3/2001 | |
| JP | 2004115995 | A * | 4/2004 | |
| JP | 3111295 | U | 6/2005 | |
| JP | 2006198939 | A | 8/2006 | |
| JP | 2013144009 | A | 7/2013 | |
| JP | 2014070286 | A | 4/2014 | |
| JP | 2019112862 | A | 7/2019 | |
| KR | 820001435 | B1 | 8/1982 | |
| KR | 101015563 | B1 | 2/2011 | |
| KR | 20120010028 | A | 2/2012 | |
| KR | 20170130534 | A | 11/2017 | |
| RU | 2569839 | C1 | 11/2015 | |
| WO | 9820505 | A1 | 5/1998 | |
| WO | WO-2008098386 | A1 * | 8/2008 | D02G 3/32 |
| WO | 2010058360 | | 5/2010 | |
| WO | 2013000995 | A1 | 1/2013 | |
| WO | 2014135850 | | 9/2014 | |
| WO | 2019143694 | A1 | 7/2019 | |
| WO | 2020131634 | A1 | 6/2020 | |

OTHER PUBLICATIONS

Adumitroaie, Adi , et al., "Stiffness and strength prediction for plain weave textile reinforced composites", Mechanics of Advanced Materials and Structures, vol. 19, 2012, 169-183.

Allaoui, S. , et al., "Mechanical and electrical properties of a MWNT/epoxy composite", Composites Science and Technology, vol. 62, 2002, 1993-1998.

Cheng, M. , et al., "Experimental investigation of the transverse mechanical properties of a single Kevlar(R) KM2 fiber", International Journal of Solids and Structures, vol. 41, 2004, 6215-6232.

English, S A., et al., "A micro to macro approach to polymer matrix composites damage modeling", Sandia Report SAND2013-10666, Dec. 2013.

English, S. , et al., "Material Characterization with Representative Volume Simulations of Woven Polymer Matrix Composites", The 19th International Conference on Composite Materials, 2013.

Li, S. , et al., "Boundary conditions for unit cells from periodic microstructures and their implications", Composites Science and Technology, vol. 68, 2008.

Nayak, S. , et al., "A microstructure-guided numerical approach to evaluate strain sensing and damage detection ability of random heterogeneous sel-sensing structural materials", Computational Materials Science, vol. 156, 2019, 195-205.

Potluri, P. , et al., "Developments in Braided Fabrics", Specialist yarn and fabric structures. Developments and Applications, ed. R.H. Gong, Woodward Publishing Ltd., United Kingdom, 2011, 333-353.

Tang, X. , et al., "Progressive Failure Behaviors of 2D Woven Composites", Journal of Composite Materials, vol. 37, 2003, 1239-1259.

Wang, L. , et al., "Progressive failure analysis of 2D woven composites at the meso-micro scale", Composite Structures, vol. 178, 2017, 395-405.

Xia, Z. , et al., "On selection of repeated unit cell model and application of unified periodic boundary conditions in micromechanical analysis of composites", International Journal of Solids and Structures, vol. 43, 2006, 266-278.

* cited by examiner

COMPOSITE-INTEGRATED ELECTRICAL NETWORKS

CROSS-REFERENCE TO RELATED APPLICATIONS

This application claims priority to and the benefit of the filing of U.S. Provisional Patent Application No. 63/165,497, entitled "Composite-Integrated Electrical Networks", filed on Mar. 24, 2021, the entirety of which is incorporated herein by reference.

STATEMENT REGARDING FEDERALLY SPONSORED RESEARCH OR DEVELOPMENT

This invention was made with government support under contract number FA864921 P0003 awarded by the United States Air Force. The government has certain rights in the invention.

BACKGROUND OF THE INVENTION

Field of the Invention (Technical Field)

The present invention is related to integrating composite yarns and fabrics incorporating same. The fabrics can be incorporated into structural composite materials, such as fiber reinforced composites, to provide integrated electrical data and power networks within the composite material.

BACKGROUND ART

Note that the following discussion may refer to a number of publications and references. Discussion of such publications herein is given for more complete background of the scientific principles and is not to be construed as an admission that such publications are prior art for patentability determination purposes.

SUMMARY OF THE INVENTION (DISCLOSURE OF THE INVENTION)

An embodiment of the present invention is a composite material comprising an embedded braided composite yarn. The surface of the embedded braided composite yarn is optionally coplanar with a surface of the composite material. The braided composite yarn is optionally embedded within the composite material. The braided composite yarn preferably comprises one or more multicomponent fiber bundles. One or more of the braided composite yarns are optionally integrated with one or more structural yarns to form a triaxial braided fabric, in which the one or more braided composite yarns preferably form the axial yarns and the one or more structural yarns preferably form the bias yarns. The composite material optionally comprises carbon fiber, such as a prepreg. The thickness of the braided composite yarn is preferably approximately the thickness of a single carbon fiber ply. The composite material optionally comprises at least one conductive wire wrapped around an axial yarn of the braided composite yarn at a location desirable for electrical contact to be made to at least one conductor in the axial yarn. At least some of the conductive wire is preferably soldered to at least one of the conductors. Alternatively, at least one conductive wire is preferably twisted with a structural yarn and is stitched across the braided composite yarn. At least some of the conductive wire is preferably soldered to at least one of the conductors in the braided composite yarn. A conductive pad is optionally soldered to the at least one conductive wire.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated into and form a part of the specification, illustrate the practice of embodiments of the present invention and, together with the description, serve to explain the principles of the invention. The drawings are only for the purpose of illustrating certain embodiments of the invention and are not to be construed as limiting the invention. In the drawings.

DETAILED DESCRIPTION OF EMBODIMENTS OF THE INVENTION

Figure 8:
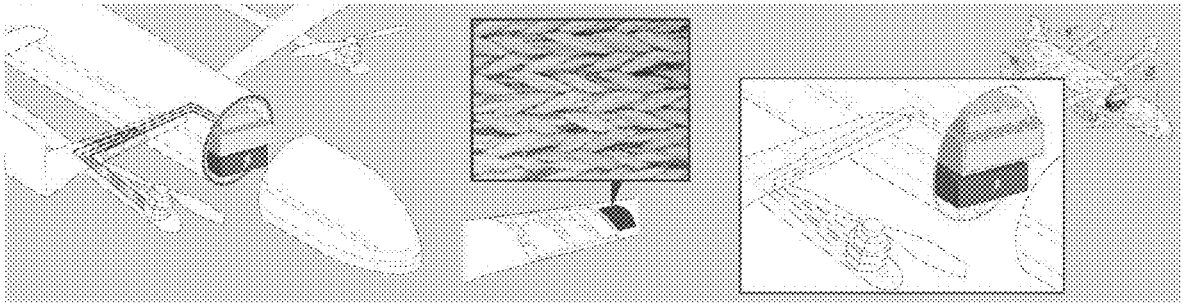
FIG. 8 shows a hypothetical application of the present invention.

Embodiments of the present invention comprise fabric yarns, tapes, and plies comprising integrated insulated or uninsulated electrical conductors, which are incorporated into laminated composite materials. In one or more embodiments, these fabrics can be integrated within composite laminates to form integrated electrical networks resulting in mass and volume-efficient functional structural systems, as shown in FIG. 8. These fabrics can be terminated using mechanical termination methods, soldering, or conductive adhesives to form robust electromechanical interconnections to electrical connectors, printed circuit board assemblies, electronic devices, or wiring harnesses.

As used throughout the specification and claims, the term "yarn" means yarn or thread. As used throughout the specification and claims, the term "structural", referring to a component fiber of a yarn, means load-bearing and providing mechanical structure and stability. As used throughout the specification and claims, the term "functional", referring to a component fiber of a yarn, means providing an electrical, electronic, optical, electromagnetic, sensing, heating, actuating, chemical, or physical function, and the like. As used throughout the specification and claims, the term "composite yarn" means a yarn comprising both structural and functional components. As used throughout the specification and claims, the term "multicomponent fiber bundle" means one or more functional components and at least one structural component that are co-wound in parallel together on a bobbin prior to braiding. A more complete description thereof may be found in International Application No. PCT/US2019/066327, incorporated herein by reference.

Composite yarns of the present invention can be integrated into woven or braided fabrics either as weft, axial, stitched, or other yarns. These yarns can be electrically terminated either individually to form discreet circuits or electrically in parallel to increase the total current carrying capacity of the circuit.

Figure 1:
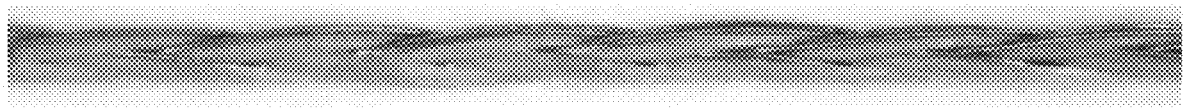
FIG. 1 is a photograph of an exemplary axial braided composite yarn comprising three multicomponent fiber bundles.
Figure 2A:
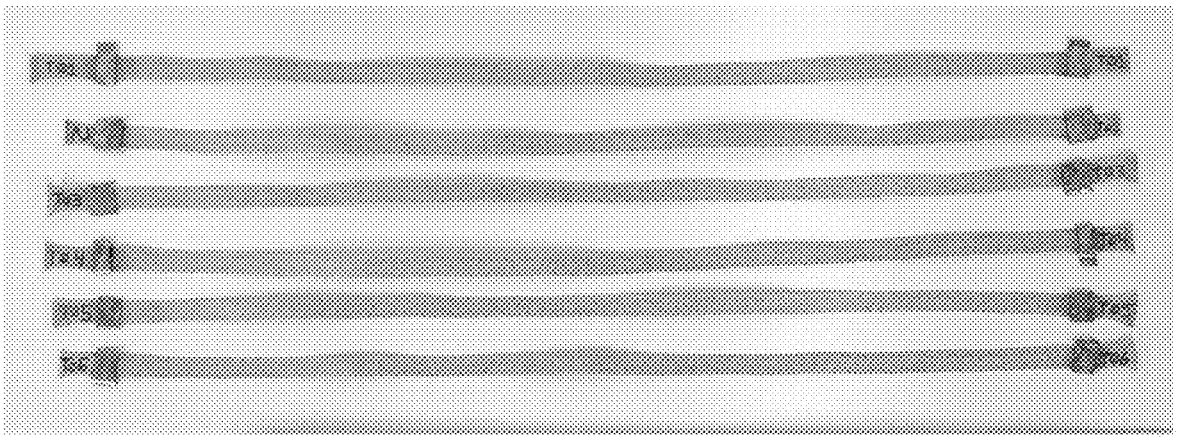
FIG. 2A is a photograph of triaxially braided tapes comprising 14 of the braided composite yarns of FIG. 1 braided as the axial yarns and 33 Tex 21 Kevlar yarns braided as the bias yarns.
Figure 2B:
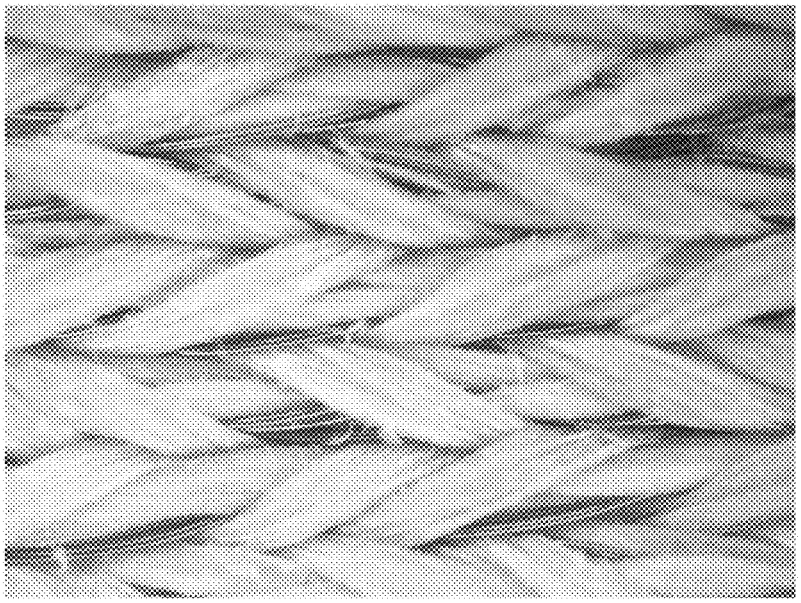
FIG. 2B is a magnified view of the triaxially braided tape of FIG. 2A.

In one or more embodiments, a triaxial braided fabric comprises a plurality of structural yarns and one or more composite yarns integrated axially. These composite yarns can be integrated such that they comprise the entirety of the triaxial braid's axial yarns to maximize its conductor content and resultant circuit density or current carrying capacity by volume. For example, the axial braided composite yarn shown in FIG. 1 comprises three multicomponent fiber bundles, of which each multicomponent fiber bundle comprises one Tex 21 Kevlar yarn and two 44AWG copper conductors with layered polyurethane and polyamide insulation, although any insulation may be used. The exemplary embodiment shown in FIG. 2A and FIG. 2B is constructed as a triaxially braided tape comprising 14 of the braided composite yarns shown in FIG. 1 braided as the axial yarns and 33 Tex 21 Kevlar yarns braided as the bias yarns. Any number of multicomponent fiber bundles may be used in a braided composite yarn, or none at all, and within each multicomponent fiber bundle or braided composite yarn any number and type of structural components and any number and type of functional components may be used.

Figure 3:
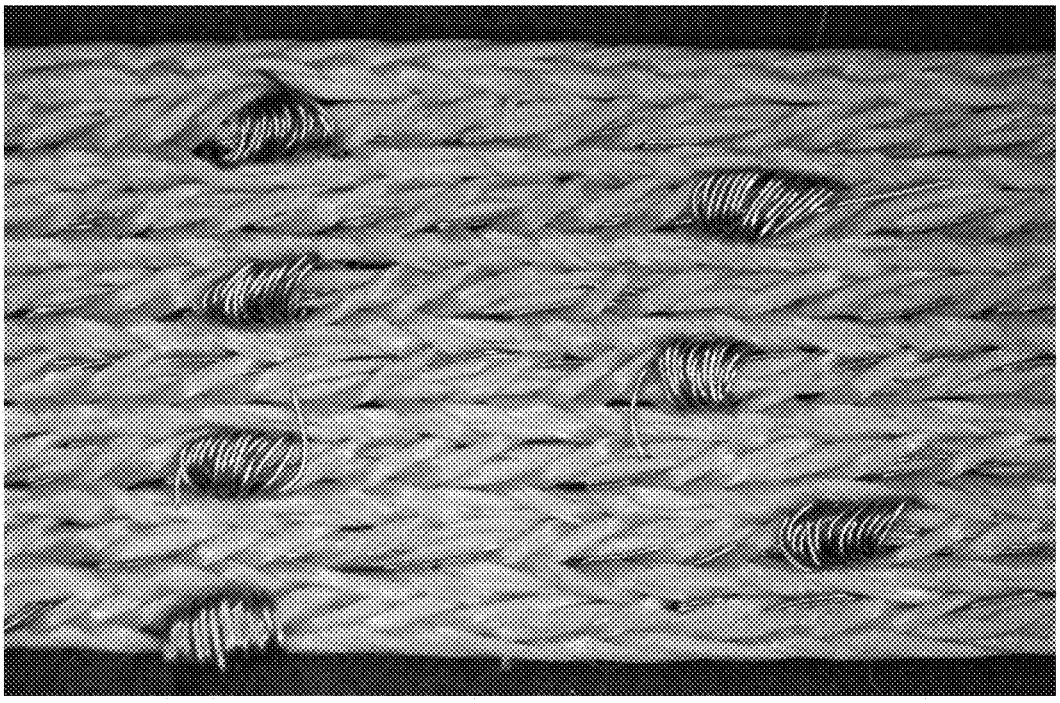
FIG. 3 shows wire wrapping around yarns in a braided composite yarn.

In order to provide electrical termination or connection to the conductors within the braided composite yarns, 40AWG tinned copper wire can be wrapped at a high tension around the axial yarns at the desired termination locations during construction. A detail of the wire wrap is shown in FIG. 3 prior to soldering. Soldering makes electrical contact between the wire wrap and the incorporated conductors, through the insulation covering each conductor, to form discreet conductive routes. Each wire wrap provides electrical contact to the conductors within the braided composite yarn or multicomponent fiber bundle it encloses. The wire wrap preferably provides addition thermal mass for improved repeatability of soldering. The embodiment shown in FIG. 3 also comprises non-conductive braided axial yarns interspersed with the braided composite axial yarns to ensure electrical isolation between discreet electrical routes within the tape.

Figure 4A:
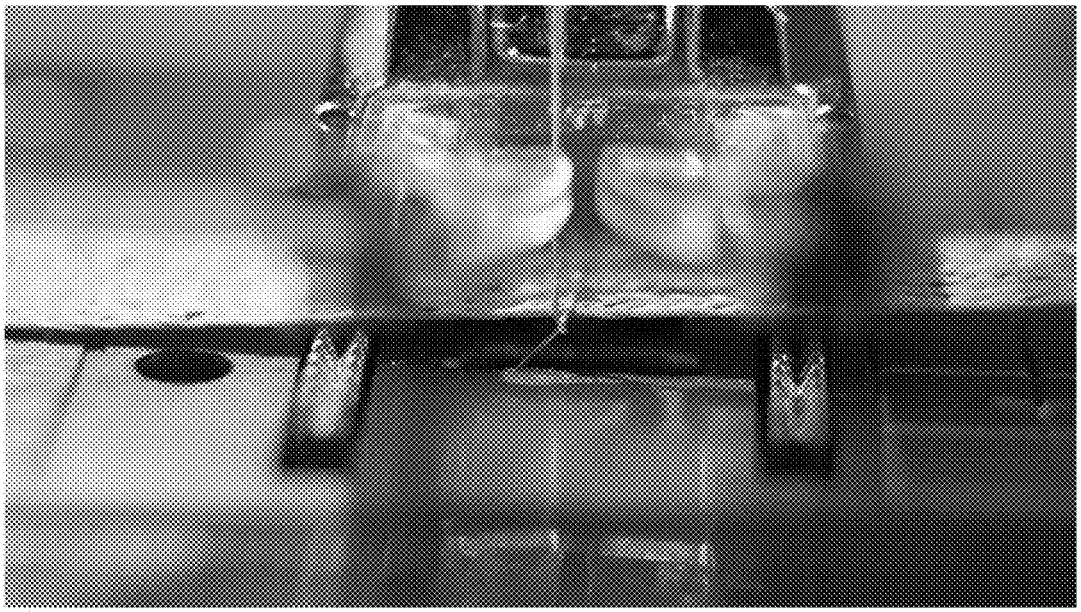
FIG. 4A shows conductors being stitched perpendicular to the length of a braided tape.
Figure 4B:
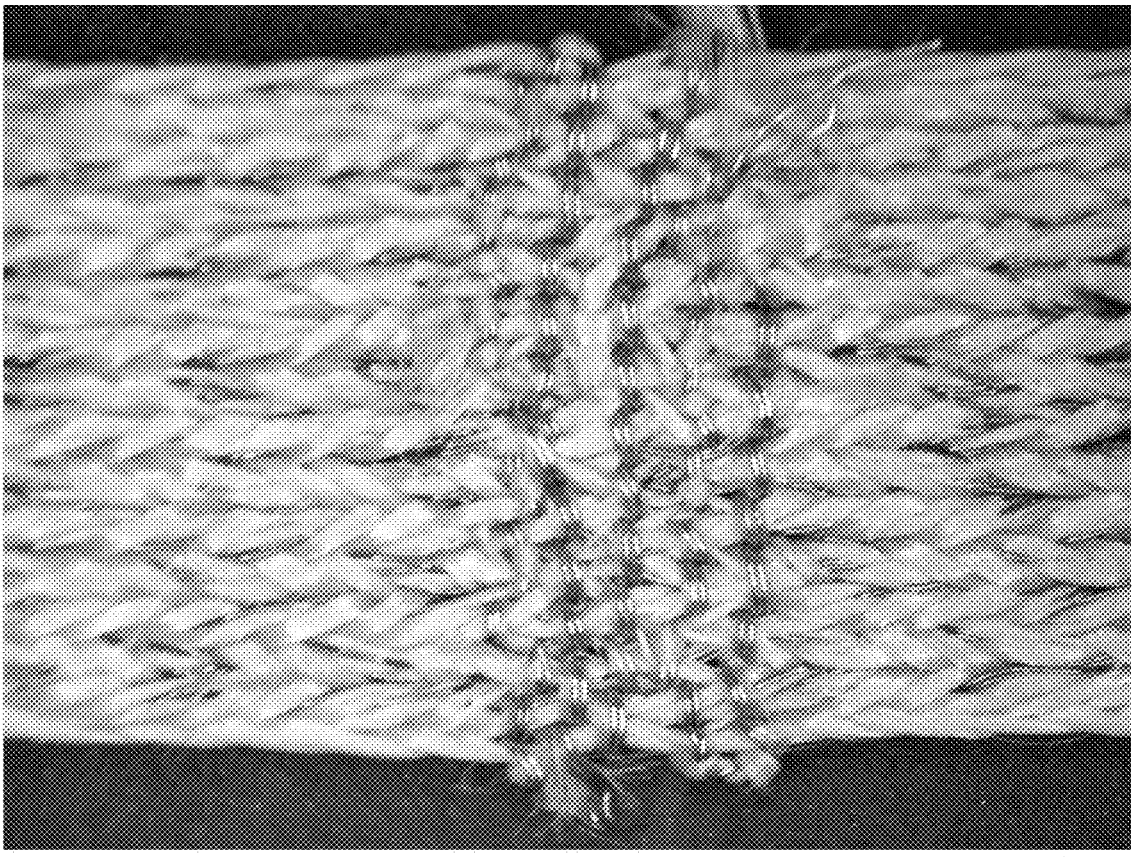
FIG. 4B shows the conductors of FIG. 4A after stitching, forming a conductive route.
Figure 4C:
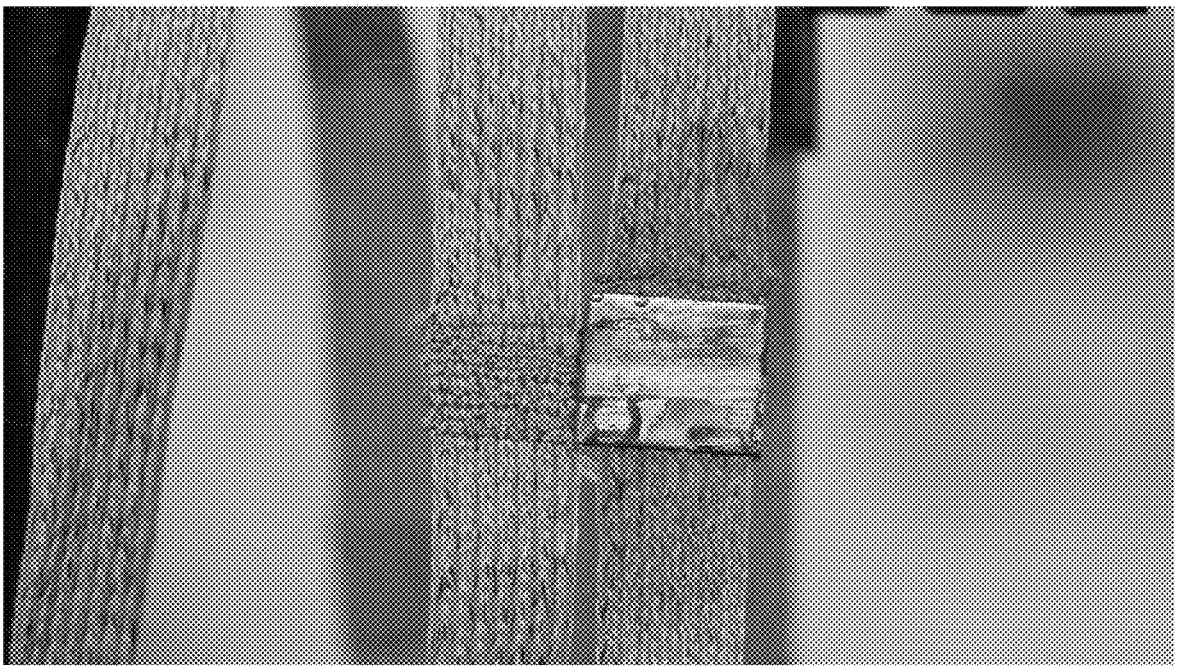
FIG. 4C shows a copper pad soldered directly to the stitched conductive route of FIG. 4B.
Figure 5A:
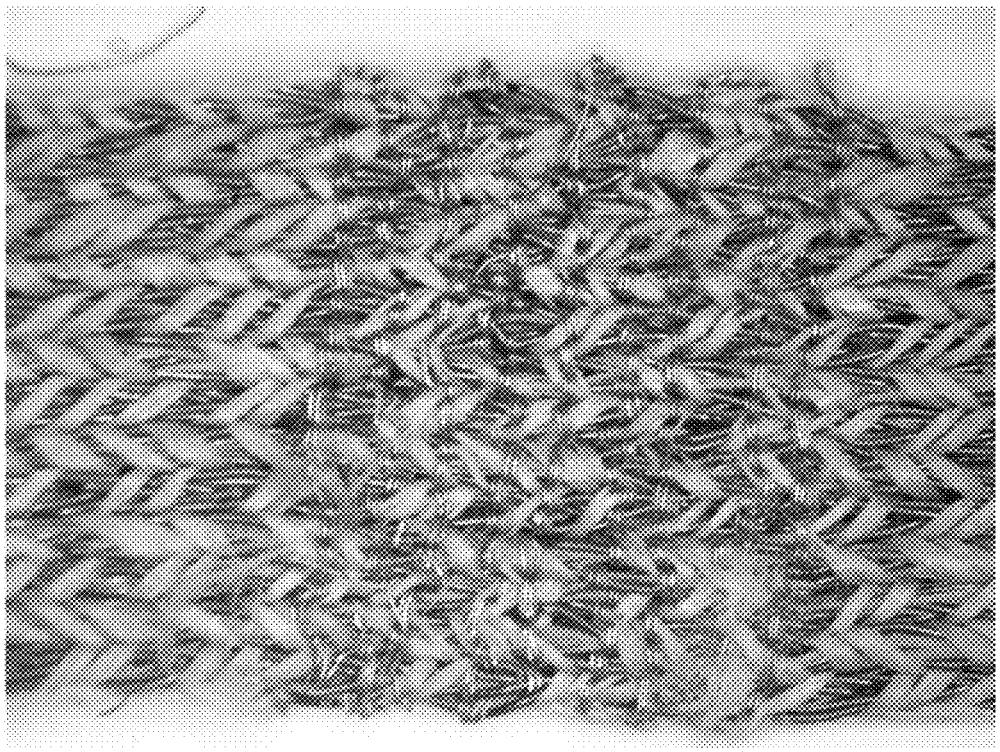
FIG. 5A shows another embodiment of conductors stitched perpendicular to the length of a braided tape.
Figure 5B:
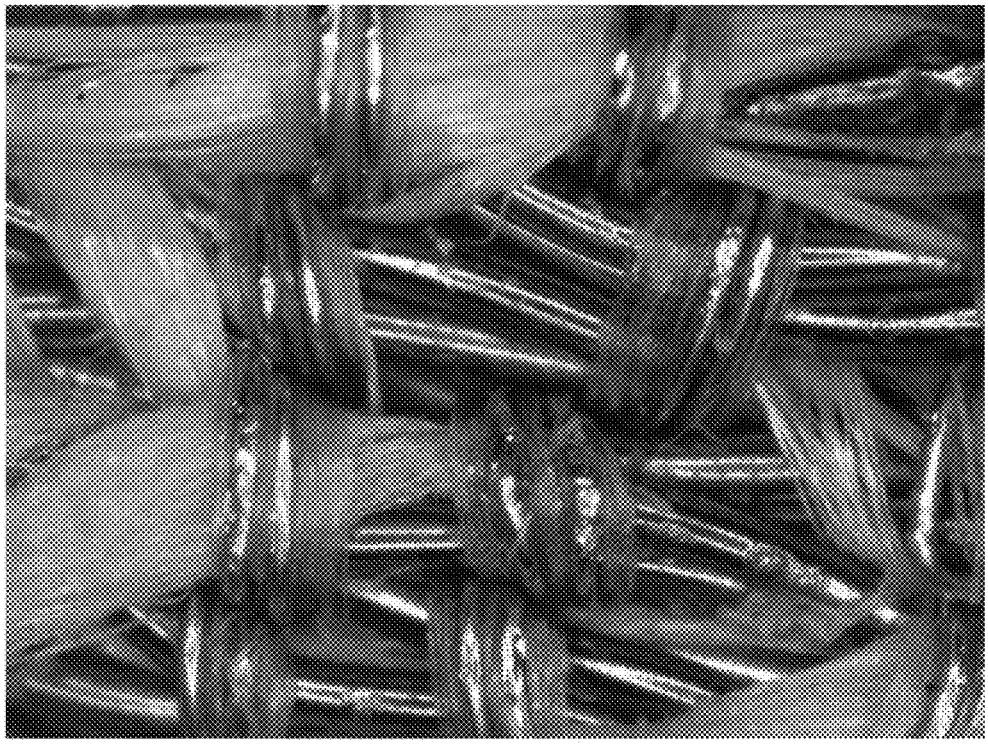
FIG. 5B is a close up view of the stitched conductive route of FIG. 5A.
Figure 5C:
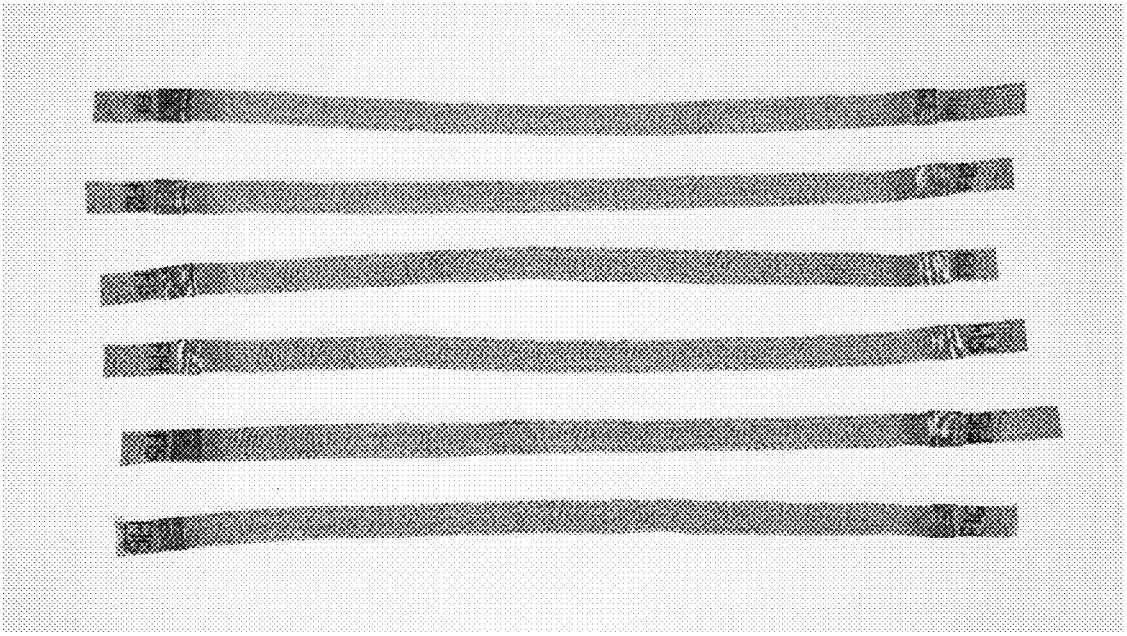
FIG. 5C shows copper pads soldered directly to the stitched conductive routes of FIG. 5A.
Figure 6A:
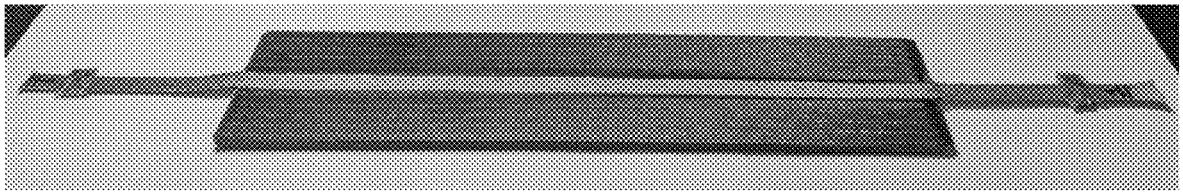
FIG. 6A shows the tape of FIG. 2A integrated into a surface of a carbon fiber composite.
Figure 6B:
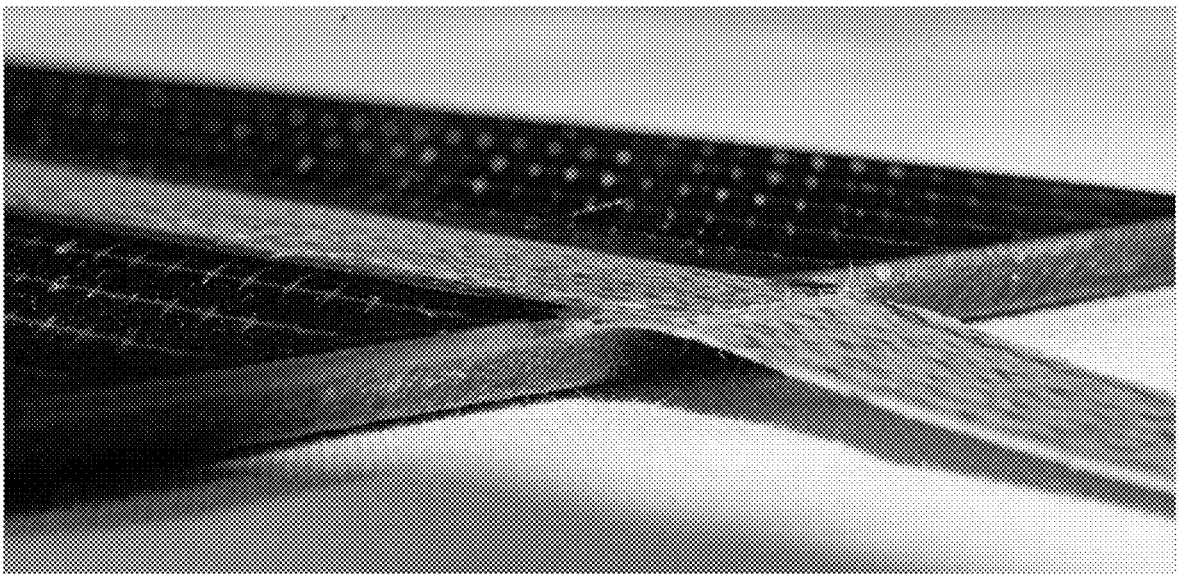
FIG. 6B is a magnified view of FIG. 6A.
Figure 6C:
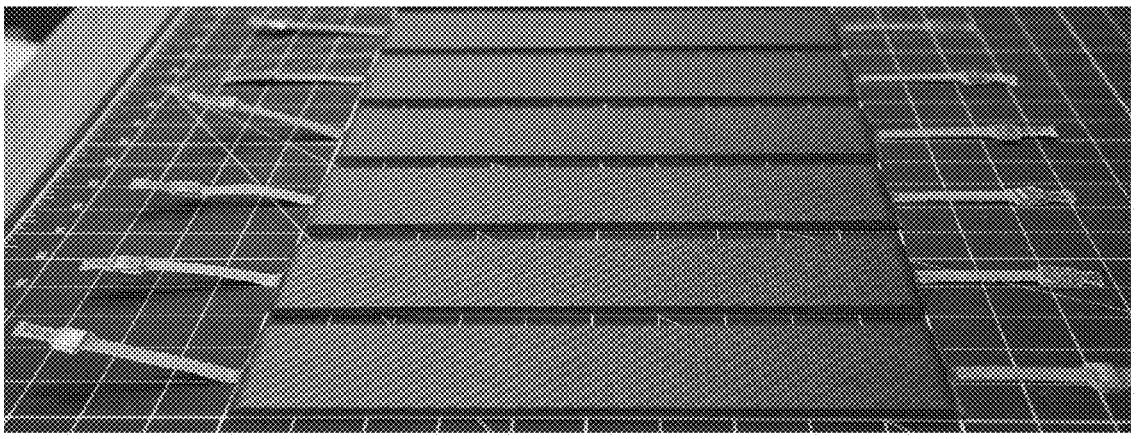
FIG. 6C shows the tape of FIG. 2A integrated within a carbon fiber composite.
Figure 7:
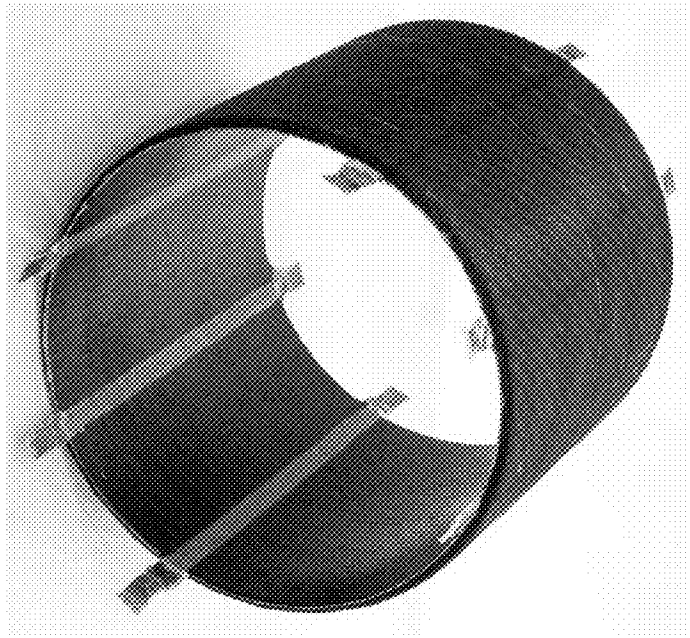
FIG. 7 shows tapes integrated into the interior surface of a cylindrical carbon fiber composite.

In an alternative electrical connection strategy, two tinned 40AWG copper conductors and one Tex 6.1 T242 Technora yarn were twisted at approximately 2 twists per inch and used in the bobbin of a sewing machine with a Tex 21 Kevlar top thread and stitched continuously one or more times perpendicular to the length of the tape, as shown in FIG. 4A. These stitched, preferably uninsulated conductors provide additional thermal mass and surface-accessible conductors to enable reliable soldering to all conductors integrated within the tape. Variations of this embodiment are shown in FIG. 4B, FIG. 5A, and FIG. 5B. FIG. 4C and FIG. 5C show tapes with copper pads soldered directly to these stitched conductive routes. The embodiments shown in FIG. 5A, FIG. 5B, and FIG. 5C incorporate axial braided composite yarns with 34AWG insulated copper conductors.

Note that while the embodiments described herein and contained within the figures are comprised of 8 mm wide tapes, the present invention is compatible with fabrics and composites of all widths and scales. The processes by which the present invention is manufactured remain the same or similar when producing these wider fabrics and composites.

EXAMPLES

Figure 9:
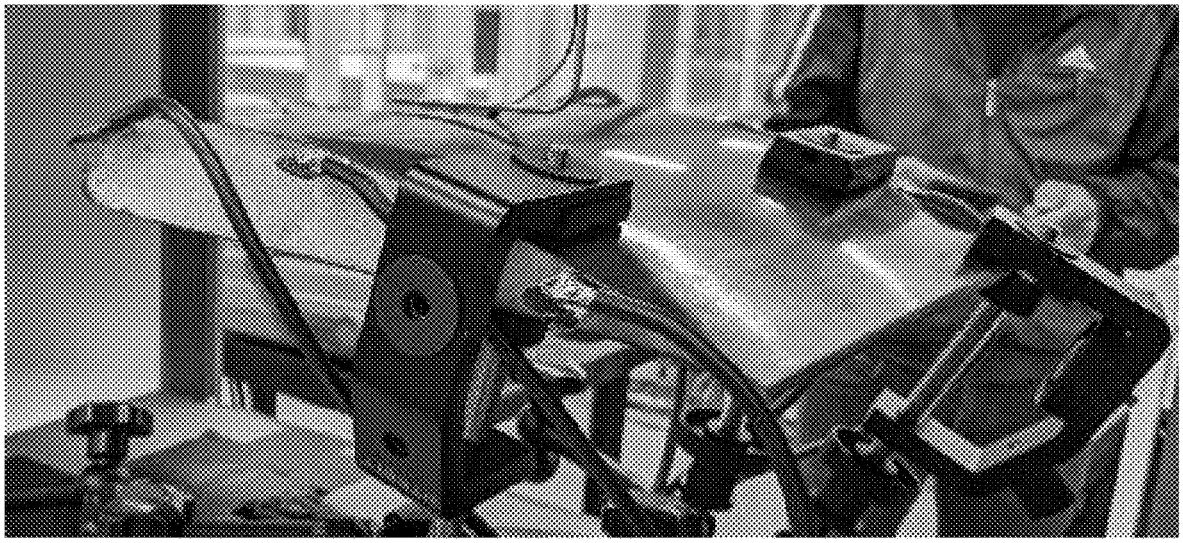
FIG. 9 is a photograph of a composite airfoil with integrated conductive tapes.

FIGS. 6A, 6B, 6C, and 7 show the tapes of FIG. 2B integrated into carbon fiber composites comprising 200 g biaxial carbon fiber prepreg and epoxy resin film. The thickness of the tapes has preferably been matched to the thickness of a single carbon fiber ply, thus enabling the conformal integration of the tape into the composite laminate without detracting from its surface finish. Mechanical, electromechanical, and thermal test methods adapted from ASTM D3039, D3822, D2412, and ISO 17713 and 18251 and multiscale numerical simulations were executed on conductive tapes, composite plates with integrated conductive tapes (FIGS. 6A, 6B, 6C), composite tubes with integrated conductive tapes (FIG. 7), and composite airfoils with integrated conductive tapes (FIG. 9).

Tensile tests were conducted to obtain the mechanical response of the composites. The tension test configuration used was adapted from ASTM D3039, and the specimens were tested using the Shimadzu AG-X plus Universal Testing Machine with 40 kips load cell. A Prosilica GC2450 from Allied Vision Technologies camera was used to record the deforming specimen's gauge area. During deformation, the speckle pattern was tracked in time and space using a 2D Digital Image Correlation technique which outputs full in-plane displacements and strains as a function of time. During testing, the load cell recorded the loading force at 1 Hz while the camera recorded the images at a frame rate of one frame per second.

Electromechanical tensile tests were executed using carbon fiber composite test articles with integrated conductive tapes comprised of triaxially braided fabrics with integrated braided composite yarns and conductive tapes respectively. Conductors within these tapes were terminated to using a quarter-bridge Wheatstone configuration to a Micro-Measurements 2210B from Vishay Precision Group, Inc. signal conditioning amplifier. The voltage output from the signal conditioner was recorded at 100 Hz with the data acquisition system.

Compression tests were conducted with a universal testing machine in parallel with surface digital image correlation and recording of the electromechanical response of the integrated conductive tapes. Each composite tube under test, similar to the one shown in FIG. 7, had a total of six conductive tapes, two in contact with the loading lines, two at the midspan of the loading plates, and two in between the other tapes. These conductive tapes were paired in a ½ bridge configuration allowing for three different responses per cylinder to be recorded. The voltage output from the signal conditioner was recorded at 100 Hz with the data acquisition system.

Throughout experimental testing, all composite-integrated electrical networks maintained their electrical response up until structural failure of the composite and exhibited a gauge factor of <1. All experimental and computational results showed strong correlations. Crash simulations were performed using published crashworthiness data on BA 747 airframes with aluminum framing and 0/45 T300 CF-EP carbon fiber skins. These tests and simulations showed that composite-integrated electrical networks would be protected in a crash event, whereas conventionally mounted wires would fail.

Thermal testing of composite-integrated tapes was performed to determine their suitability for constructing convectively cooled high-current power networks, multifunctional de-icing systems, and thermal signature manipulation systems. Testing was performed in an Aerolab Wind tunnel wind tunnel using an airfoil with 3 conductive tapes, each integrating 84 insulated 34AWG conductors under 15 A and 30 A loads at 13 volts DC with airspeeds from 0 to 60 mph as recorded with a pilot tube. Steady-state temperatures of the free stream air and surface of the airfoil were recorded using thermocouples and thermal imaging systems, respectively. Testing demonstrated a decrease in heat transfer as wind velocity increased, indicating cooling from airflow at a greater proportion than the increase in convection coefficient. This reduction in heat transfer indicates that further increases in load would need to be substantial for the temperature to rise significantly, especially at higher airflow velocities.

Note that in the specification and claims, "about" or "approximately" means within twenty percent (20%) of the numerical amount cited. As used herein, the singular forms "a," "an," and "the" include plural referents unless the context clearly dictates otherwise. Thus, for example, reference to "a functional group" refers to one or more functional groups, and reference to "the method" includes reference to equivalent steps and methods that would be understood and appreciated by those skilled in the art, and so forth.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. A fiber-reinforced composite comprising an embedded braided composite yarn, the braided composite yarn comprising at least one functional component comprising an electrical conductor braided together with at least one structural component.

2. The fiber-reinforced composite of claim 1 wherein a surface of the embedded braided composite yarn is coplanar with a surface of the fiber-reinforced composite.

3. The fiber-reinforced composite of claim 1 wherein the braided composite yarn is embedded within the fiber-reinforced composite.

4. The fiber-reinforced composite of claim 1 wherein the braided composite yarn comprises one or more multicomponent fiber bundles.

5. The fiber-reinforced composite of claim 1 wherein one or more of the braided composite yarns are integrated with one or more first structural yarns to form a triaxial braided fabric.

6. The fiber-reinforced composite of claim 5 wherein the one or more braided composite yarns form the axial yarns of the triaxial braided fabric and a plurality of the one or more first structural yarns forms the bias yarns of the triaxial braided fabric.

7. The fiber-reinforced composite of claim 1 comprising carbon fiber.

8. The fiber-reinforced composite of claim 7 wherein at least some of the carbon fiber is in the form of one or more carbon fiber plies, and the thickness of the braided composite yarn is approximately the thickness of a single carbon fiber ply.

9. The fiber-reinforced composite of claim 6 comprising at least one conductive wire wrapped around one or more of the axial yarns.

10. The fiber-reinforced composite of claim 9 wherein the conductive wire is soldered to the at least one conductor forming the functional component in the axial yarn.

11. The fiber-reinforced composite of claim 9 wherein the at least one conductive wire is stitched across the one or more axial yarns.

12. The fiber-reinforced composite of claim 11 wherein the at least one conductive wire is twisted with a second structural yarn.

13. The fiber-reinforced composite of claim 11 wherein at least some of the conductive wire is soldered to at least one of the conductors forming the functional components in the one or more axial yarns.

14. The fiber-reinforced composite of claim 11 comprising a conductive pad soldered to the at least one conductive wire.

* * * * *